US006745580B1

(12) United States Patent
Brown

(10) Patent No.: US 6,745,580 B1
(45) Date of Patent: Jun. 8, 2004

(54) COMBINATION P-TRAP, SHUTOFF SWITCH AND CLEANOUT FITTING

(76) Inventor: David Brown, 14010 Townemist Port, Sugarland, TX (US) 77478

( * ) Notice: Subject to any disclaimer, the term of this patent is extended or adjusted under 35 U.S.C. 154(b) by 204 days.

(21) Appl. No.: 10/094,905

(22) Filed: Mar. 12, 2002

(51) Int. Cl.[7] ..... G01K 13/00

(52) U.S. Cl. ..... 62/129; 62/272; 137/192

(58) Field of Search ..... 62/126, 129, 272, 62/285; 137/59, 192

(56) References Cited

U.S. PATENT DOCUMENTS

| | | | | |
|---|---|---|---|---|
| 4,633,673 A | | 1/1987 | Morrison et al. | |
| 4,693,091 A | | 9/1987 | O'Mara et al. | |
| 4,892,045 A | * | 1/1990 | Schumacher | 110/203 |
| 4,998,412 A | | 3/1991 | Bell | |
| 5,402,813 A | | 4/1995 | Keen | |
| 5,644,925 A | * | 7/1997 | Chaves | 62/289 |
| 5,797,426 A | | 8/1998 | Powell | |
| 6,068,023 A | * | 5/2000 | Potter | 137/625.47 |

* cited by examiner

*Primary Examiner*—Melvin Jones
(74) *Attorney, Agent, or Firm*—Kenneth A. Roddy

(57) ABSTRACT

A combination P-trap, shutoff switch and cleanout fitting for installation in a drain line has a hollow generally cylindrical body with a central chamber, an integrally formed tubular inlet and outlet, and a removable cap with a depending float switch which is disposed in the chamber. The float switch is electrically connected between the thermostat and air handler unit. The inlet conducts liquid from a drain pan into the lower portion of the chamber beneath a partition and the outlet conducts water from the upper portion of the chamber into the downstream portion of the drain line. When the surface of the liquid in the chamber is above the partition the device functions as a P-trap to prevent backflow of undesirable gases and odors from downstream being drawn up through the drain line by the air conditioner recirculation fan and entering into the system. As long as the float switch is in a lowermost or intermediate position, power is supplied to the thermostat, and the air conditioner operates in a conventional manner. When the downstream portion of the drain line becomes obstructed, the level of liquid in the chamber and the float rises above the intermediate level to close the switch and interrupt the circuit to the thermostat, thereby shutting off the air conditioner and preventing the accumulation of further liquid in the drain pan which might otherwise overflow and damage ceilings, walls, and flooring. The cap and float switch can be removed to clean the chamber and/or blow the upstream or downstream portions of the drain line clear of the obstruction.

9 Claims, 2 Drawing Sheets

COMBINATION P-TRAP, SHUTOFF SWITCH AND CLEANOUT FITTING

BACKGROUND OF THE INVENTION

1. Field of the Invention

This invention relates generally to air conditioning equipment and drain lines, and more particularly to a combination P-trap, shutoff switch, and clean-out fitting for use in a condensate drain line associated with the fan coil of an air conditioning system.

2. Brief Description of the Prior Art

In the normal operation of an air conditioning system, the evaporator or fan coil tends to be at temperatures below the dew point of the surrounding air. The resulting condensation is collected in a drain pan located under the coil, with the pan then being drained off to an appropriate disposal site such as a sewer drain or to the ground outside via a drain line. It is very common for the drain pan and/or the drain line to become plugged or clogged by debris that may fall into the drain pan or sedimentary material which accumulates in the drain line, which results in the liquid in drain pan overflowing and thereby damaging or destroying ceilings, walls and flooring.

It is common in many installations to install a capped tee-fitting or clean out in the drain line to provide access to the interior of the drain line so that a clogged or plugged drain line can be serviced by introducing air or other gas under pressure to blow the obstruction out of the drain line.

There are also devices know in the art that may be connected in the drain line to mechanically or electrically de-activate the air conditioning system when a blockage or excessive build-up of sedimentary material occurs within the condensate line.

Because of a low pressure condition that is created by the operation of the fan inside the unit, it has become conventional practice, and a requirement in many city codes, to provide a P-trap in the drain line to isolate the system from the backflow of dangerous or undesirable gases and odors that would otherwise occur when the system is connected to discharge condensate directly to the sewer.

Thus, it requires three separate fittings to be installed in the drain line in order to shut off the air conditioner to prevent liquid in drain pan from overflowing, to prevent the backflow of dangerous or undesirable gases and odors into the system, and to provide access to the interior of the drain line for clearing it of obstructions.

Therefore, it would be desirable to provide a single fitting which can be installed in the condensate drain line, which would function as a P-trap, a shut off switch, and a clean out fitting.

Others have attempted to overcome these problems, however none of the devices of the prior art are capable of performing all of the utilitarian functions of present invention.

Morrison et al, U.S. Pat. No. 4,633,673 discloses an emergency shutoff for air conditioners comprising a fitting mounted in the drain pan with a primary drain opening and a secondary or emergency drain opening for draining away fluid accumulated in the pan when the primary drain becomes blocked. A one-way valve is provided in the drain for preventing back flow of air or other fluids from the drain to the pan, and a venturi is positioned in the drain pan to produce a low pressure from the flow of air circulated by the air conditioner fan. A tube connects the venturi with a reservoir which collects the fluid drained by the emergency drain, whereby the fluid is evacuated through the emergency drain.

O'Mara et al, U.S. Pat. No. 4,693,091 discloses a condensate disposal system for an air conditioning system having a condensate tube interconnecting a condensate pan and a trap. A vent is provided in the condensate tube for relieving any internal pressure that would otherwise cause a restriction of condensate flow within the condensate tube.

Bell, U.S. Pat. No. 4,998,412 discloses a sediment alert and purging unit for a condensate drain pan and removal return line of a refrigeration system. The unit includes an element for monitoring the level of condensate within the condensate drain pan and removal line, a switch element for disabling the compressor and air handler of the refrigeration system responsive to an unacceptable level of condensate within the drain pan and removal line, and an annunciation element with the switch element to alert a user when a disabling of the compressor and air handler has occurred. The unit also includes a purge port within the condensate removal line and a first condensate line closure valve disposed upstream of the purge port. Further provided is a second condensate line closure valve disposed downstream of the purge port. Through the location of closure valves both upstream and downstream of the purge port, a clogged condensate line may be purged, either upstream or downstream of the purge port by effecting the closure of that closure valve located at that side of the purge valve opposite to where the condensate blockage is believed to exist.

Keen, U.S. Pat. No. 5,402,813 discloses an in-line algaecide dispenser having a central vertical chamber with an inlet and outlet in communication therewith in laterally opposed horizontally aligned relation and a removable cap threadedly engaged at the top end of the chamber. The dispenser is installed in a condensate or cold water drain line and a water-leachable algaecide tablet is placed in the central chamber of the dispenser to prevent growth of cold-water algae and provide protection from clogging or plugging of the downstream condensation or drain line by algae for as long as the algaecide takes to dissolve in the flowing stream of condensate.

Powell, U.S. Pat. No. 5,797,426 discloses a combination check valve and fluid trap device for connection to the outflow aperture of a condensate moisture drain system on an air conditioner, ice maker, cooler or like apparatus. The device comprises a ball float sealingly seated on a float seat within a housing, the float seat being connected to the outflow conduit of a generally U-shaped fluid trap having an inflow conduit for connection to the drain system, whereby water and gas are prevented from entering the fluid trap through the outflow conduit but excess water will move the ball float from the float seat to allow water to flow out of the outflow conduit. Preferably the fluid trap is provided with rotation means whereby the longitudinal axis of the inflow conduit can be adjusted relative to the longitudinal axis of the outflow conduit so that the two axes are not aligned in parallel.

SMD Research, Inc. of Boca Raton, Fla., manufactures and markets a safety switch, known as the Safe-T-Switch®, which is installed in an air conditioner condensate drain between the drain pan outlet and the P-trap to detect down stream clogs in condensate drains and interrupt the thermostat circuit to shut off the unit before flooding occurs. It may also be installed to activate an alarm. This device has a generally tee-shaped configuration and does not replace the P-trap.

The present invention is distinguished over the prior art in general, and these patents in particular by a combination P-trap, shutoff switch and cleanout fitting for installation in a drain line which has a hollow generally cylindrical body with a central chamber, an integrally formed tubular inlet and outlet, and a removable cap with a depending float switch which is disposed in the chamber. The float switch is electrically connected between the thermostat and air handler unit. The inlet conducts liquid from a drain pan into the lower portion of the chamber beneath a partition and the outlet conducts water from the upper portion of the chamber into the downstream portion of the drain line. When the surface of the liquid in the chamber is above the partition the device functions as a P-trap to prevent backflow of undesirable gases and odors from downstream being drawn up through the drain line by the air conditioner recirculation fan and entering into the system. As long as the float switch is in a lowermost or intermediate position, power is supplied to the thermostat, and the air conditioner operates in a conventional manner. When the downstream portion of the drain line becomes obstructed, the level of liquid in the chamber and the float rises above the intermediate level to close the switch and interrupt the circuit to the thermostat, thereby shutting off the air conditioner and preventing the accumulation of further liquid in the drain pan which might otherwise overflow and damage ceilings, walls, and flooring. The cap and float switch can be removed to clean the chamber and/or blow the upstream or downstream portions of the drain line clear of the obstruction.

SUMMARY OF THE INVENTION

It is therefore an object of the present invention to provide a single fitting for drain lines that replaces and performs the functions of a P-trap, a shutoff switch, and clean-out fitting.

It is another object of this invention to provide a combination P-trap, shutoff switch, and clean-out fitting that will detect clogs downstream in a condensate drain line and shut off the air condensing unit before expensive water damage can occur to ceilings, walls, and flooring.

It is another object of this invention to provide a combination P-trap, shutoff switch, and clean-out fitting that will sound an alarm upon detection of clogs downstream in a condensate drain line and shut off the air condensing unit before expensive water damage can occur to ceilings, walls, and flooring.

Another object of this invention is to provide a combination P-trap, shutoff switch, and clean-out fitting which will prevent poisonous gases and bad odors from entering a building through the air conditioning system.

Another object of this invention is to provide a combination P-trap, shutoff switch, and clean-out fitting having a removable cap that allows easy access to clean out deposits left by an evaporator coil, and/or blow the drain line clear upstream or downstream when it becomes clogged.

A further object of this invention is to provide a combination P-trap, shutoff switch, and clean-out fitting that is easily and quickly installed in a condensate drain line or other drain line.

A still further object of this invention is to provide a combination P-trap, shutoff switch, and clean-out fitting that is simple in construction, inexpensive to manufacture, and rugged and reliable in operation.

Other objects of the invention will become apparent from time to time throughout the specification and claims as hereinafter related.

The above noted objects and other objects of the invention are accomplished by a combination P-trap, shutoff switch and cleanout fitting for installation in a drain line which has a hollow generally cylindrical body with a central chamber, an integrally formed tubular inlet and outlet, and a removable cap with a depending float switch which is disposed in the chamber. The float switch is electrically connected between the thermostat and air handler unit. The inlet conducts liquid from a drain pan into the lower portion of the chamber beneath a partition and the outlet conducts water from the upper portion of the chamber into the downstream portion of the drain line. When the surface of the liquid in the chamber is above the partition the device functions as a P-trap to prevent backflow of undesirable gases and odors from downstream being drawn up through the drain line by the air conditioner recirculation fan and entering into the system. As long as the float switch is in a lowermost or intermediate position, power is supplied to the thermostat, and the air conditioner operates in a conventional manner. When the downstream portion of the drain line becomes obstructed, the level of liquid in the chamber and the float rises above the intermediate level to close the switch and interrupt the circuit to the thermostat, thereby shutting off the air conditioner and preventing the accumulation of further liquid in the drain pan which might otherwise overflow and damage ceilings, walls, and flooring. The cap and float switch can be removed to clean the chamber and/or blow the upstream or downstream portions of the drain line clear of the obstruction.

DESCRIPTION OF THE PREFERRED EMBODIMENT

Figure 1:
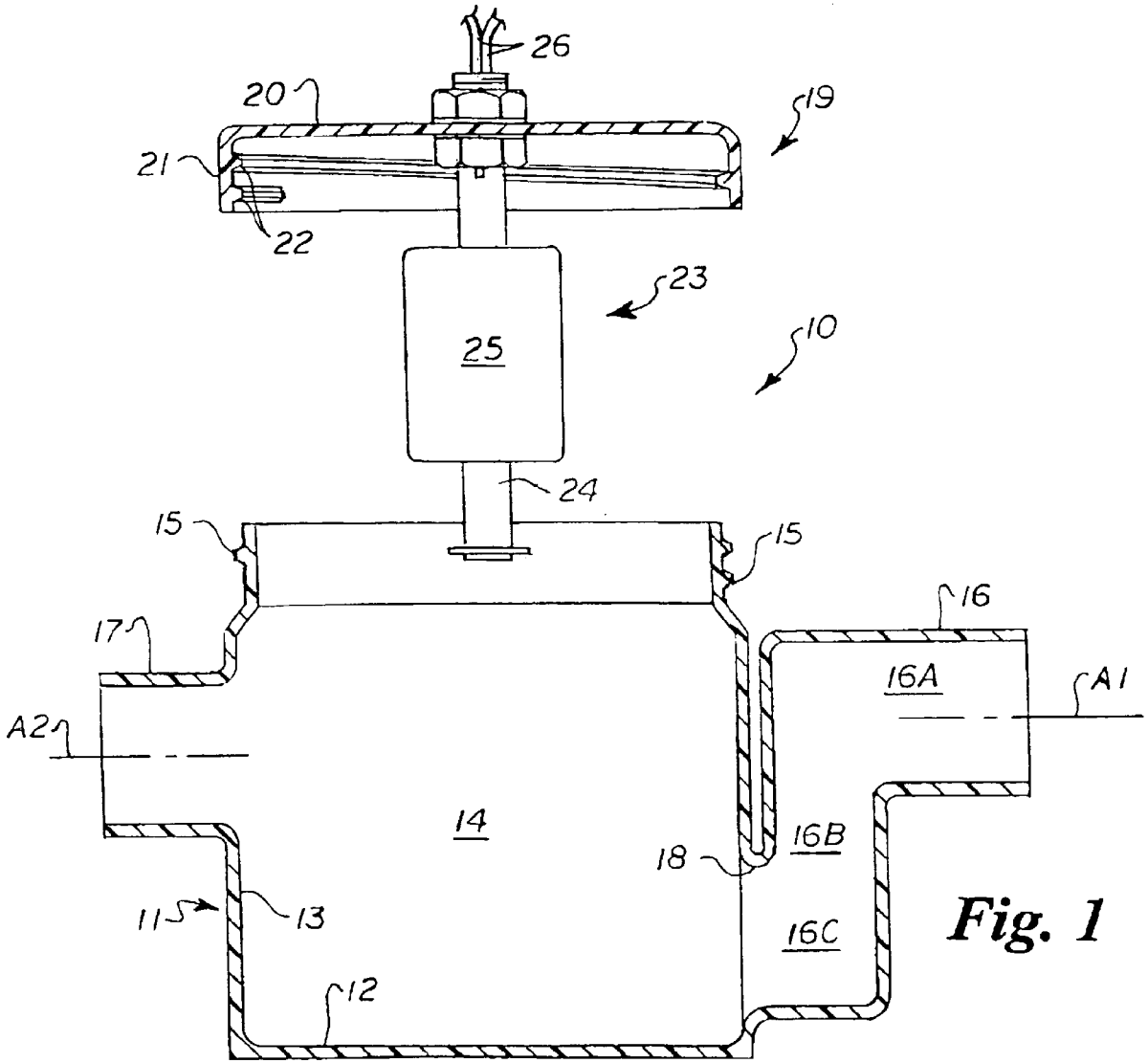
FIG. 1 is a side view in cross section of the combination P-trap, shutoff switch, and clean-out fitting in accordance with the present invention, shown with the cap and float switch in an unassembled condition.
Figure 2:
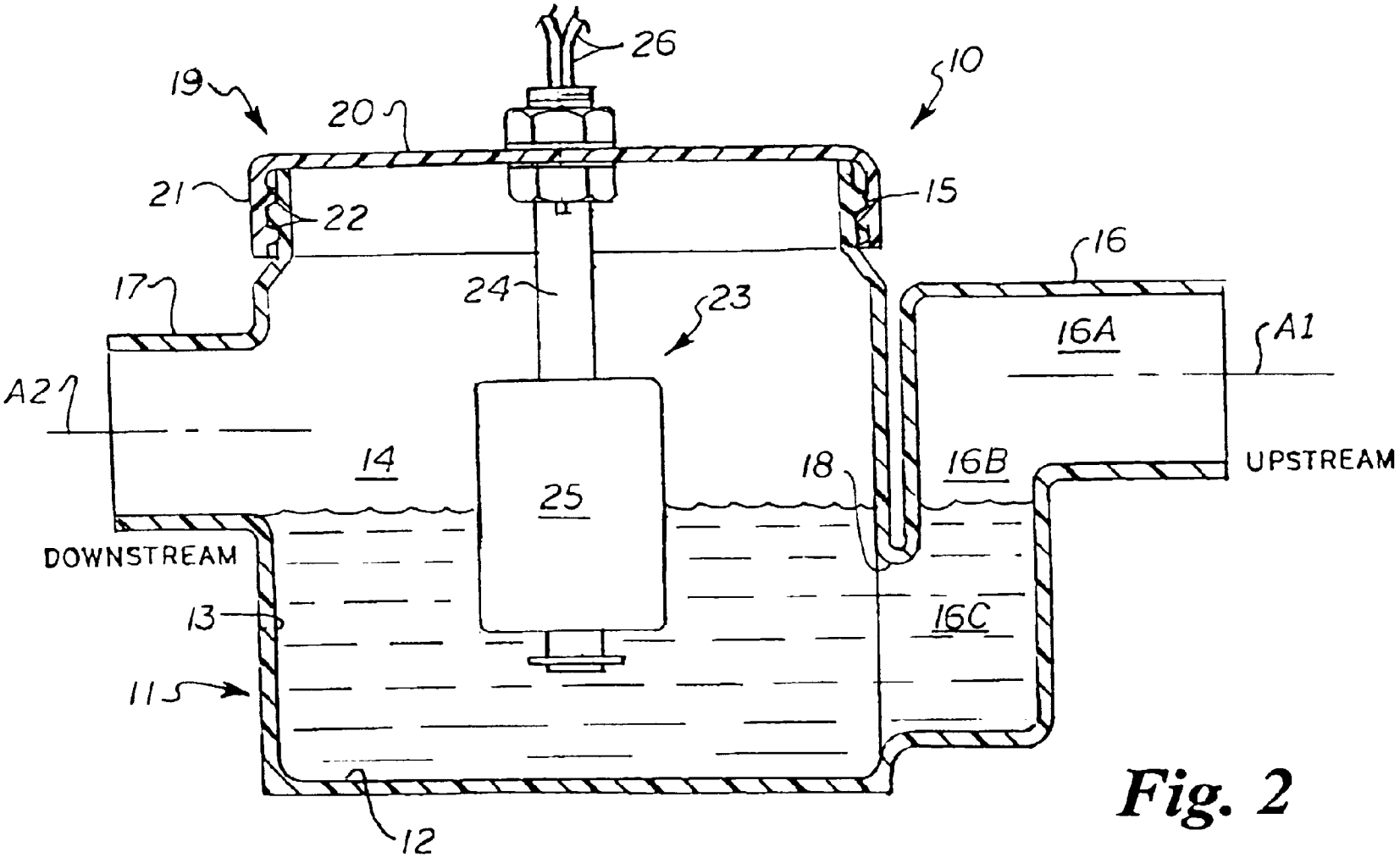
FIG. 2 is a side view in cross section of the combination P-trap, shutoff switch, and clean-out fitting, shown with the cap and float switch in an assembled condition.

Referring to the drawings by numerals of reference, there is shown in FIGS. 1 and 2, a preferred embodiment of the combination P-trap, shutoff switch, and clean-out fitting 10. FIG. 1 shows the cap and float switch in an unassembled condition and FIG. 2 shows the fitting 10 in a normal fluid filled condition with the cap and float switch installed.

The combination fitting 10 has a unitary hollow generally cylindrical body 11 with a bottom wall 12 and a peripheral side wall 13 extending upwardly therefrom defining a central chamber 14. The open top end of the body 11 is provided with external threads 15. The body 11 has an integrally formed tubular inlet 16 and outlet 17.

The inlet 16 has a horizontal tubular top portion 16A with a central axis A1 that extends outwardly from the body 11, a vertical portion 16B that extends downwardly from the inner end of the top portion, and a bottom portion 16C that opens into the central chamber 14 near the bottom wall 12. The juncture of the opening of the bottom portion 16C with the side wall 13 forms a partition 18 a distance above the bottom wall of the body 11.

The interior of the tubular outlet 17 is in fluid communication with the central chamber 14 near its upper end and extends horizontally outward therefrom along a central axis A2.

The top portion 16A of the inlet 16 and outlet 17 extend laterally outward from the body 11 in diametrically opposed relation. The central axis A2 of the outlet 17 is disposed in a horizontal plane a distance above the bottom end of the partition 18 and the central axis A1 of the top portion of the inlet 16 is disposed in a horizontal plane a short distance above the outlet axis A2.

A removable cap 19 having a top wall 20 and a circumferential side wall 21 with internal threads 22 is threadedly engaged on the external threads 15 of the body 11 and encloses its open top end. A float switch 23 mounted on the cap 19 has a central shaft 24 secured to the top wall of the cap with a float element 25 slidably mounted on the shaft.

The float switch 23 is preferably a magnetic switch of the type that senses a preset liquid level. A commercially available float switch suitable for use is a model number FS-6205 level sensor manufactured by Aleph International Corporation of San Fernando, Calif. Such a float switch has a magnetic sensing element mounted in the stationary shaft 24 of the sensor and a ring magnet mounted in the float element 25 which moves relative to the stationary shaft. A pair of insulated wires 26 connected with the sensing element extend from the top end of the shaft 24 for connection to the 24-volt electrical circuit of the air conditioning system. When the float 25 reaches the level of the sensing element, a switch closure occurs. Preferably, the threads 15 and 22 on the body 11 and cap 19 are designed to allow the cap to be installed and removed by rotating it only ¼ or ½ of a turn to prevent twisting of the wires of the float switch.

Installation

Before installing the combination fitting 10, power to the air conditioning unit should be disconnected to avoid electrical shock and/or equipment damage.

A bucket or pail is placed under the section of the primary drain line that is to be cut. A section approximately 6" long is cut out of the primary drain line, using pvc cutters, as close to the evaporator coil as possible, and leaving at least 1" extending outwardly from the drain pan. A ¾" coupling is cemented with pvc cement to the 1" section of the primary drain line. The top portion 16A of the inlet 16 of the combination fitting 10 is then cemented to the ¾" coupling, making sure that cap 19 and wires 26 of the float switch are facing upward.

A second ¾" inch coupling is cemented to the remaining section of the drain line, and the tubular outlet 17 of the combination fitting 10 is cemented to the second ¾" coupling.

After locating the 24-volt thermostat wires connected with the air handler unit, the red thermostat wire connected with the air handler unit is cut and the insulation at the cut ends is striped back approximately ¼" inch. Each of the two wires 26 of the combination fitting 10 is connected to a respective stripped end of the cut red wire with a wire nut.

To prevent condensation from forming on the exterior of the combination fitting 10, the sides and bottom of the fitting and the couplings may be wrapped with insulation tape.

Operation

During normal operation of the air conditioning system, the central chamber 14 of the combination fitting 10 will be dry, and when condensation collected in the drain pan is properly draining through the primary drain line and combination fitting 10, the liquid will enter the central chamber near its bottom wall 12 through the bottom portion 16C of the inlet 16 and will rise to a height sufficient to exit the outlet 17 and flow downstream through the drain line.

The float switch 23 is calibrated such that when the liquid in the central chamber 14 has risen to a height sufficient to exit the outlet 17 and flow downstream through the drain line, the float element 25 will be moved from a lowermost position to an intermediate position and the thermostat circuit connected with the air handler unit will remain closed to function normally, and when the float is moved a predetermined height above its intermediate position, the float switch will open the circuit and render the air conditioning system inoperative.

As seen in FIG. 2, when the liquid in the central chamber 14 has risen to a height sufficient to exit the outlet 17 and flow downstream through the drain line, the surface of the liquid is above the partition 18 and bottom portion 16C of the inlet 16 and will prevent gases from the downstream portion of the drain line from being drawn up through the drain line by the air conditioner recirculation fan and entering into the environment through the inlet 16. Thus, the combination fitting 10 functions as a P-trap to isolate the air conditioning system from the backflow of undesirable gases and odors.

As long as the float 25 is in a lowermost or intermediate position, a circuit is established and power is supplied to the thermostat, enabling the air conditioner to be energized in a conventional manner. However, in the event the downstream portion of the drain line becomes obstructed and the level of liquid in central chamber 14 rises above the intermediate level, the float 25 is carried upwardly, closing the switch and interrupting the circuit to the thermostat, thereby shutting off the air conditioner and preventing the accumulation of further liquid in the drain pan which might otherwise overflow and damage ceilings, walls, and flooring. Thus, the combination fitting 10 serves as an emergency shutoff switch.

The cap 19 can be easily removed to periodically inspect and/or clean the central chamber 14 of deposits left by the evaporator coil which may have entered from the drain pan. In the event that the downstream portion or the upstream portion of the drain line does become obstructed or clogged, the power to the air conditioning unit is disconnected to avoid electrical shock and/or equipment damage. The cap 19 and the float switch 23 mounted thereon is removed from the body 11 by unscrewing the cap and the nozzle or end of a hose connected with a source of air or other gas under pressure is inserted into the central chamber 14 to blow the upstream or downstream drain line clear of the obstruction. Thus, the combination fitting also serves as a cleanout fitting.

It should also be understood that the combination fitting 10 may be connected with an alarm circuit by additionally joining the wires 16 in parallel with a visual or audible alarm connected with an electrical power source through a relay, such that when the level of liquid in the central chamber 14 rises above the intermediate level, and the float is carried upwardly, the switch closes to interrupt the circuit to the thermostat and shuts off the air conditioner, and simultaneously activates the relay to close the alarm circuit and actuate the alarm. Thus, providing a visual or audible indication that the drain line has become obstructed and needs attention.

While this invention has been described fully and completely with special emphasis upon a preferred embodiment, it should be understood that within the scope of the appended claims the invention may be practiced otherwise than as specifically described herein.

What is claimed is:

1. A combination fluid trap, shutoff valve and cleanout device for use with fluid drain systems that remove condensate moisture from refrigeration systems such as air conditioners, comprising:

a housing having a bottom wall and a side wall defining a central chamber, a fluid inlet having an inflow opening in said central chamber and a tubular outer end for connection to an upstream conduit segment of a fluid drain system, and a fluid outlet having an outflow opening in said central chamber and a tubular outer end for connection to a downstream conduit segment of the fluid drain system;

said fluid inlet outer end positioned higher than said fluid outlet outer end and said outflow opening positioned higher than said inflow opening whereby condensate from upstream flows through said inlet outer end, into said central chamber through said inflow opening, and upon rising to a sufficient height, an upper portion of condensate exits through said outflow opening and said outlet outer end to flow downstream, and a lower portion of the condensate remains in said central chamber at a level higher than said inflow opening to prevent downstream gases and odors from passing upstream through said inflow opening said fluid inlet.

2. The device according to claim 1, wherein said housing, said fluid inlet, and said fluid outlet are formed as an integral one-piece fitting.

3. The device according to claim 1, wherein said housing central chamber is sized and shaped to receive an end of a hose connected with a source of air or other gas under pressure whereby pressurized air or gas may be introduced into said central chamber and said fluid inlet and said fluid outlet to blow the upstream conduit segment and downstream conduit segment of the fluid drain system clear of obstructions.

4. The device according to claim 1, further comprising:

liquid level switch means in said central chamber for sensing the level of condensate therein, said switch means in electrical communication with the refrigeration system for disabling at least a compressor or air handler of said refrigeration system responsive to an unacceptable level of condensate in said central chamber.

5. The device according to claim 4, wherein said liquid level switch means is in electrical communication with an alarm circuit responsive to disabling the compressor or air handler of said refrigeration system to indicate that the condensate in said central chamber has reached an unacceptable level.

6. The device according to claim 1, wherein said housing is a generally cylindrical configuration having a generally vertical central axis, said fluid inlet tubular outer end and said fluid outlet tubular outer end extend horizontally outward from said housing in diametrically opposed relation;

said housing has an open top end, and further comprising;

a cap member removably installed on said open top end to enclose said central chamber.

7. The device according to claim 1, wherein said inlet tubular outer end extends horizontally outward from said housing along a longitudinal axis, and said outlet tubular outer end extends horizontally outward from said housing along a longitudinal axis a distance vertically below the longitudinal axis of said inlet tubular outer end.

8. The device according to claim 6, wherein said inflow opening is disposed a distance vertically below said longitudinal axis of said inlet tubular outer end and is adjoined thereto by a generally vertical passageway, and said outflow opening is disposed in alignment with said longitudinal axis of said outlet tubular outer end.

9. The device according to claim 1, wherein said housing is a generally cylindrical configuration having a generally vertical central axis, said fluid inlet tubular outer end and said fluid outlet tubular outer end extend horizontally outward from said housing in diametrically opposed relation;

said housing has an open top end, and further comprising:

a cap member removably installed on said open top end to enclose said central chamber; and liquid level switch means on said cap having a float element disposed in said central chamber for sensing the level of condensate therein, said switch means in electrical communication with the refrigeration system for disabling at least a compressor or air handler of said refrigeration system responsive to an unacceptable level of condensate in said central chamber.

* * * * *